US005653083A

United States Patent [19]

Alderman et al.

[11] Patent Number: 5,653,083

[45] Date of Patent: Aug. 5, 1997

[54] RAISABLE SIDE GUIDES FOR APPARATUS FOR PAYING OUT AN INSULATION SUPPORT SHEET

[75] Inventors: Robert J. Alderman, Canyon Lake; James E. Taylor, Seguin, both of Tex.

[73] Assignee: Owens-Corning Fiberglas Technology, Inc., Summit, Ill.

[21] Appl. No.: 537,177

[22] Filed: Sep. 29, 1995

[51] Int. Cl.[6] ..... E04F 21/00; B65H 16/06

[52] U.S. Cl. ..... 52/749.12; 52/407.4; 52/746.11; 242/598.5; 242/557

[58] Field of Search ..... 52/407.4, 407.5, 52/749.12, 746.11, 404; 242/557, 598.5, 610.3, 548; 270/30.13, 30.02, 31.1

[56] References Cited

U.S. PATENT DOCUMENTS

| | | | |
|---|---|---|---|
| 3,559,914 | 2/1971 | Alderman | 242/557 |
| 3,969,863 | 7/1976 | Alderman | 52/407.4 |
| 4,047,345 | 9/1977 | Alderman | 52/407.4 |
| 4,047,346 | 9/1977 | Alderman | 52/407.4 |
| 4,068,446 | 1/1978 | Brueske | 52/749.12 |
| 4,075,807 | 2/1978 | Alderman | 52/407.4 |
| 4,078,355 | 3/1978 | Clemensen | 52/749.12 X |
| 4,147,003 | 4/1979 | Alderman | 52/749.12 |
| 4,222,212 | 9/1980 | Alderman | 142/598.5 |
| 4,967,535 | 11/1990 | Alderman | 52/749.12 |

*Primary Examiner*—Carl D. Friedman
*Assistant Examiner*—Winnie Yip
*Attorney, Agent, or Firm*—C. Michael Gegenheimer; Curtis B. Brueske

[57] ABSTRACT

An apparatus for providing a roof structure of the type having a plurality of purlins spaced apart from one another in a parallel arrangement, is disclosed. A carriage moves in a first direction along the length of the purlins and pays out a support sheet for support of insulation material as the carriage travels along the length of the purlins. The support sheet depends from the top portion of adjacent purlins. At least one guide member guides the carriage along the length of the purlins and prevents the carriage from moving in a direction lateral to the first direction when the guide member is in a first position. The guide member is pivotally mounted on the carriage so that the guide member can be elevated into a second position to avoid obstructions encountered as the carriage moves along the length of the purlins. The guide member includes a movable arm which is pivotally mounted on the carriage and has a roller for rolling against a purlin while the guide member is in the first position. The guide member also includes a spring having two ends, with one of the ends being engaged with the movable arm and the other end engaged with the carriage. A spring biases the movable arm towards the first position and a handle is attached to the movable arm for manually elevating the guide member to the second position.

17 Claims, 4 Drawing Sheets

RAISABLE SIDE GUIDES FOR APPARATUS FOR PAYING OUT AN INSULATION SUPPORT SHEET

TECHNICAL FIELD

This invention relates to the construction of an insulated metal roof structure for use in commercial and industrial buildings.

BACKGROUND ART

Metal roof structures typically comprise a series of parallel rafter beams extending across the building in one direction and purlin beams parallel to each other mounted on top of the rafters extending in a direction normal to the rafters. The purlins are often joined together by support bracing or straps for extra support. Insulation material in long sheets is placed in the area between purlins. The sheets of insulation material can be laid along the length of the purlins or across the purlins in a direction normal to the purlins. Hard roofing material such as metal decking is then attached on top of the purlins over the insulation material. Because the hard roofing material comes in long sheets and the roofs generally have two sloped sections, it is customary to construct the roof along the width of the sloped section and then proceed along the length of the structure from one end to the other. The workers stand on the previously laid section of roof to construct the next section.

The insulation material must be supported between the purlins, and various methods of support have been used. Mounting straps or wire mesh that are attached to the purlins by forming a lattice have been used. This is referred to as banding. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is required.

Some systems dispense with the lattice and use the sheet itself to support the insulation material. The support sheet is draped from the adjacent purlins and the insulation material is placed on top of the support sheet. A carriage is used to aid in the dispensing of the support sheet. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins the support sheet is draped across the purlins.

The carriage has guides that guide the carriage along the length of the purlins to insure that the carriage tracks correctly along the purlins. The guides also insure that the carriage does not move laterally with respect to the purlins. The guides prevent the carriage from falling between the purlins and insures that the support sheet is properly dispensed between the purlins. The guides have a downwardly extending member that is mounted on the carriage and near the side of a purlin. If the carriage were to move in a lateral direction the guide would contact the purlin and prevent any further lateral movement in that direction. For example, guides having an L-shaped cross-section have also been used to guide the carriage. The L-shaped guides have a laterally extending leg that slides on the top surface of the purlins and a downwardly extending leg that contacts the side of the purlin. Two opposing guides are mounted on the carriage and above two adjacent purlins.

These guides are typically bolted or rigidly fixed to the carriage in some other manner, such as welded or riveted.

Because the purlin support bracing is generally attached towards the top portion of the purlin, the guides often hit the support bracing, and this prevents the carriage from traveling along the purlins. Bolts or rivets that extend up above the tops of the purlins may also obstruct parts of a guide, such as the laterally extending leg of the L-shaped guide. In these cases the carriage must be lifted up over the obstruction so that the carriage can continue moving along the length of the purlins. Since the carriage is fairly heavy and bulky, the lifting can be dangerous to the workers standing on the uncompleted roof structure. The guides can be unbolted or unfastened and temporarily removed until the carriage has passed the obstruction, but this is also dangerous to the workers since the carriage is riding on the purlins only and the workers must lean over the edge of previously laid section of the roof to get to the guides.

It would be desirable to have a system for building a roof structure that provides for an insulation support system which is convenient and efficient to construct.

DISCLOSURE OF INVENTION

There has now been invented an improved apparatus for providing a roof structure, which dispenses a support sheet for supporting insulation material between purlin roof beams. The apparatus provides for a convenient and efficient system to construct a roof structure.

The present invention comprises an apparatus for use on a roof structure of the type having a plurality of purlins spaced apart from one another in a parallel arrangement. The apparatus includes a carriage movable in a first direction along the length of the purlins for paying out a support sheet for support of insulation material as the carriage travels along the length of the purlins. The support sheet depends from the top portion of adjacent purlins. The carriage also includes at least one guide member guiding the carriage along the length of the purlins and preventing the carriage from moving in a direction lateral to the first direction when the guide member is in a first position. The guide member is mounted on the carriage so that the guide member can be elevated into a second position away from obstructions encountered as the carriage moves along the length of the purlins. Preferably, the guide member includes a spring which biases the guide member. The guide member can also have a roller that rolls against a purlin while the guide member is in the first position.

Two guide members can be attached to the carriage in which one guide member prevents the carriage from moving in a first lateral direction, and the other one prevents the carriage from moving in a second lateral direction, where the second lateral direction is opposite the first lateral direction. A single guide member having two rollers positioned on opposite sides of a purlin can also be used, where the first roller prevents the carriage from moving in the first lateral direction, and the second roller prevents the carriage from moving in the second lateral direction.

In a specific embodiment of the invention the guide member includes a movable arm and a guide surface which contacts the purlin for preventing the carriage from moving in a lateral direction. The movable arm is pivotally mounted on the carriage for movement to the second position to avoid obstructions encountered as the carriage is moving in the first direction. The guide surface can be a roller mounted on the movable arm.

In another embodiment of the invention, the guide member can be slideably mounted on the carriage so that the guide member can be slideably elevated to the second position to avoid obstructions.

BEST MODE FOR CARRYING OUT THE INVENTION

Figure 1:
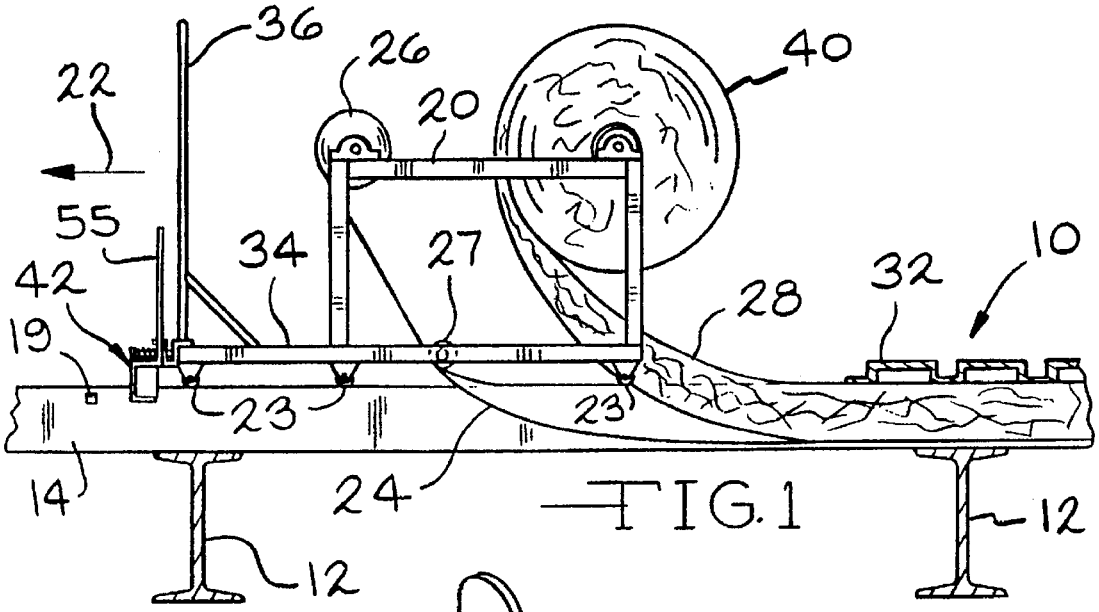
FIG. 1 is a sectional view in elevation of the apparatus of the invention, including a carriage and guide member.

There is illustrated in FIG. 1 a building roof structure generally indicated at 10. The roof structure is typically supported by main rafter beams 12 which are positioned parallel to each other. A plurality of purlins 14, spaced apart and arranged parallel to each other, are fastened on top of the rafters in a direction normal to the rafters. The spacing of the purlins is typically 5 feet on centers. Roof structures may also be constructed from bar joists or trusses, and the invention as described herein will work equally well with purlins, bar joists or trusses. The use of the term "purlins" in this specification and claims includes not only traditional purlins, but also bar joists and trusses and other similar structural members.

Figure 2:
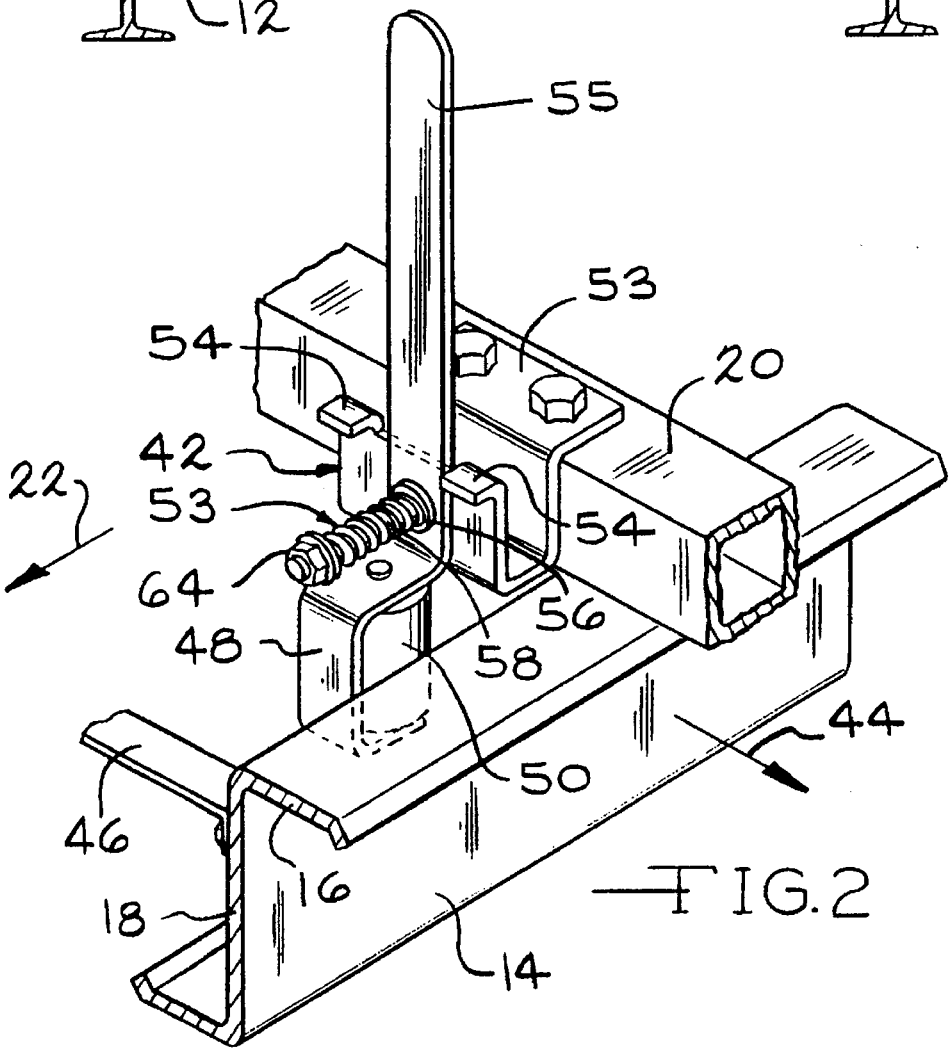
FIG. 2 is a perspective view of the guide member shown in the first position.

As can be seen in FIG. 2, the purlins have a generally Z-shaped cross-section and include a top portion 16 and a vertical portion 18. The purlins are typically joined by purlin support mechanisms 19, such as bracing, which provide for extra support so that the purlins do not tilt or lean over during the lifetime of the roof structure. The support mechanisms can be of any suitable bracing material such as straps, angle iron or U-channels and can be welded, bolted or snapped onto the purlins. The support mechanisms are generally attached to the vertical portion 18 of the purlins near the top portion 16, or attached to the top portion itself.

As shown in FIG. 1, a carriage 20 rides on top of the purlins and travels in a first direction 22 along the length of the purlins. The carriage rolls along the top of the purlins by support rollers 23 that are mounted at the bottom of the carriage. As the carriage is moved, a support sheet 24 is dispensed from a roll 26 which is mounted on the carriage. The carriage can be any suitable apparatus for dispensing the support sheet. The support sheet is fed under a dispensing roller 27 which is mounted on the carriage and helps spread out the support sheet as the support sheet is dispensed. The support sheet is draped on top of adjacent parallel purlins so that the support sheet depends from the top portions 16 of the purlins. The support sheet supports a layer of insulation material 28 that is placed on top of the support sheet between the adjacent purlins. Long sheets of hard roofing material 32 such as metal decking are then attached to the top portion of the purlins over the support sheet. The attachment of the hard roofing material supports the portion of the support sheet that is directly underneath. The carriage may include a standing platform 34 and a guardrail 36 provided for a worker operating the carriage.

Although the carriage is shown as extending between only two purlins, the carriage can be any width up to the width of the roof itself. Multiple support sheet rolls can be mounted on a single carriage in an overlapping fashion so that multiple insulation cavities are insulated at one time. Likewise, multiple carriages can be used and moved in unison as the roof is constructed.

Because the hard roofing material comes in long sheets and the roofs generally have two sloped sections, it is customary to construct the roof along the width of the sloped section and then proceed along the length of the structure from one end to the other. The workers stand on the previously attached hard roofing material to assemble the next section of roof. The carriage travels along the length of the purlins and is moved by the workers as each section of roof is assembled. The carriage can be pushed by a push rod or can be propelled by any other suitable means, such as by a cable hooked to a winch or a motor.

The space between the vertical portions of adjacent purlins defines an insulation cavity (indicated at 38 in FIG. 6) having a generally rectangular cross-sectional shape. It is advantageous to fill the insulation cavity with as much insulation material as possible. The greater the mount of insulation material occupying the insulation cavity, the higher the insulating qualities the roof structure will have. The purpose of the support sheet is to support the insulation material in the insulation cavity, but the support sheet can also be used as a vapor barrier and for aesthetic purposes. The support sheet can be of any suitable material for the stated purposes, such as vinyl or foil faced paper. The width of the support sheet is generally such that its edges slightly overhang the adjacent purlins.

The insulation material can be dispensed from a roll 40 mounted on the carriage, and in a direction parallel to the length of the purlins. The insulation material may also be laid across the purlins in a direction normal to their lengths. In this case, the workers unroll a long sheet of insulating material and place it across the purlins in front of the previously completed roof. The hard roofing material is attached to the purlins over the insulation material and the carriage is moved along the purlins as needed. This insulation may be added on top of the insulation material between the purlins for additional thermal protection or as the only source of insulation material.

A guide member 42 is mounted on the carriage to guide the carriage along the length of the purlins to insure that the carriage tracks correctly along the top portion of the purlins. The guide member can be of any suitable configuration to prevent the carriage from falling between the purlins, and to insure that the support sheet is properly dispensed between the purlins. The guide member is needed since the support rollers 23 do not prevent movement of the carriage in a lateral direction 44. The lateral direction 44 is normal to the first direction and parallel to a plane defined by the plurality of purlins.

The guide member is also mounted for vertical movement so that the guide member can be elevated out of the way from obstructions encountered as the carriage moves along the length of the purlins. Typical obstructions include purlin support bracing, such as strap 46, attached to the purlins usually near the top portion to provide for extra support. The guide member can be mounted by any suitable means that would allow the guide member to be easily positioned up over the obstruction. The guide member should be mounted in such a way that it can be moved easily rather than unbolted or otherwise removed from the carriage.

FIG. 2 is a perspective view of guide member 42 which is in contact with a purlin 14. The guide member comprises of a movable arm 48 having a roller 50. The roller contacts the purlin and rolls along the purlin as the carriage moves in the first direction 22. This prevents the carriage from moving in the lateral direction 44. The movable arm is pivotally mounted by a spring assembly 52 to a mounting bracket 53. The mounting bracket is bolted to a section of the carriage 20. The mounting bracket has tabs 54 that prevent the movable arm from rotating in a vertical plane normal to the purlins. The movable arm can also include a handle 55 for manually elevating the guide member to the second position by a worker standing on the platform 34.

Figure 3:
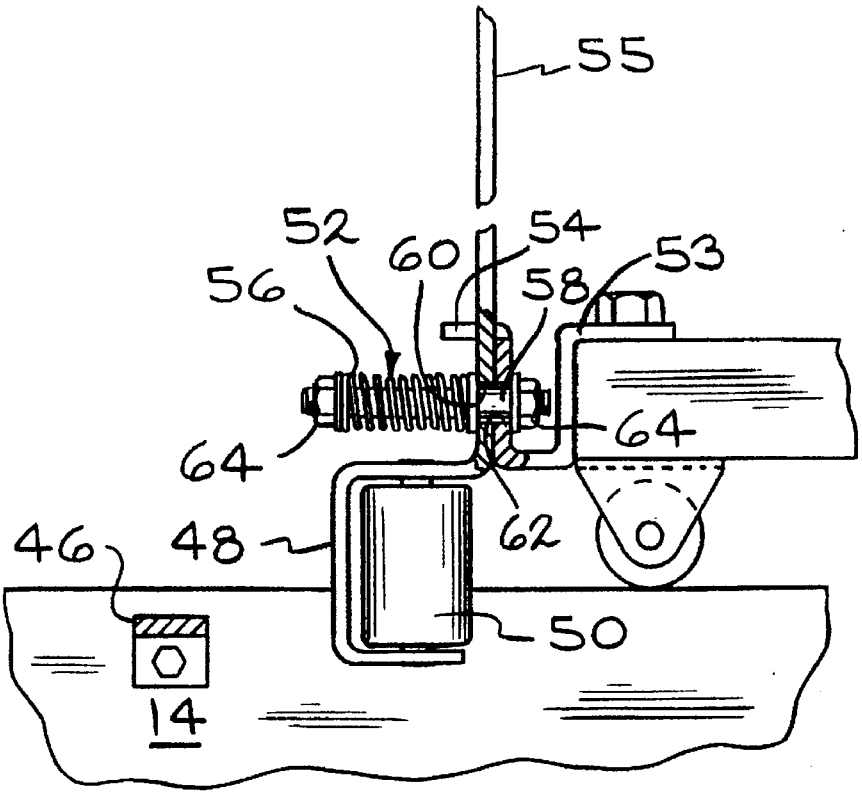
FIG. 3 is a side elevational view of the guide member in the first position.
Figure 4:
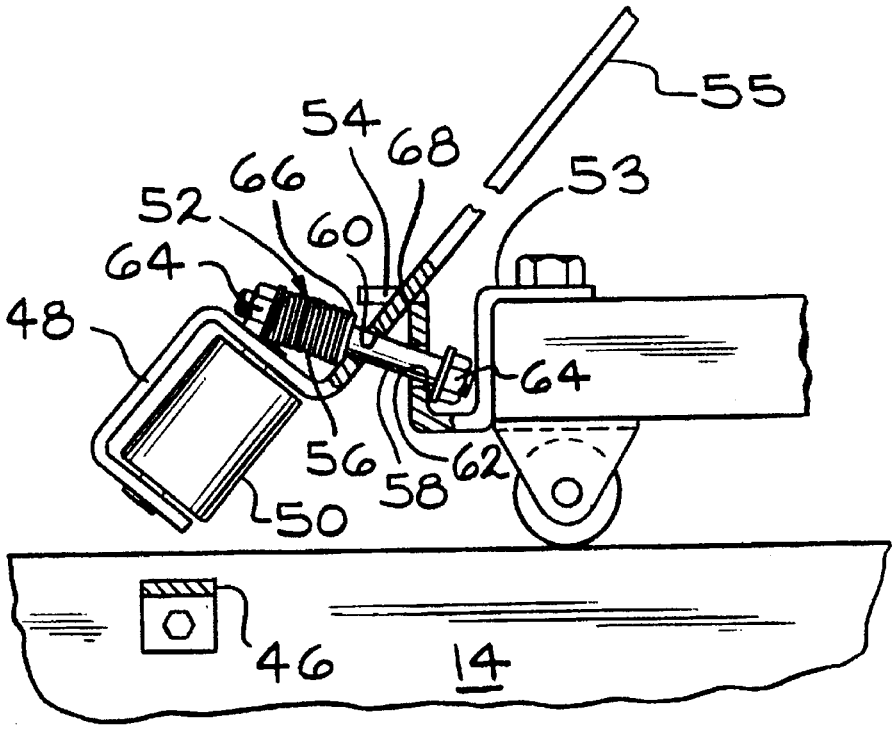
FIG. 4 is a side elevational view of the guide member of FIG. 3 shown in the second position.

As seen in FIG. 3, the guide member is in a first position, which is the normal downward position of the guide member as the carriage moves along the purlins. In this first position the roller 50 contacts and rolls along the side of the purlin. When an obstruction is encountered the guide member is elevated to a second position out of the way of the obstruction, as shown in FIG. 4. The carriage can then travel in the first direction. When the obstruction has passed the guide member is then lowered to its normal operating downward position.

The spring assembly 52 biases the guide member towards the downward position. The spring assembly includes a coil spring 56 that is positioned around shaft 58. The shaft is inserted through a slot 60 in the movable arm and through a slot 62 in the mounting bracket. The shaft is not fixed with respect to the movable arm or the mounting bracket. Two retaining nuts 64 are threadably fastened to ends of the shaft. The spring compresses against one of the retaining nuts and a washer 66 butting against the movable arm. The position of the retaining nuts can be changed to compress or relax the spring to alter the spring force. The spring assembly is arranged so that the ends of the spring are engaged with the mounting bracket and the movable arm so as to bias the movable arm towards the first position against the mounting bracket. When the movable arm is moved to the second position, the movable arm is pivoted at pivot point 68 and compresses the spring. As best seen in FIG. 4, the slots 60 and 62 are sufficiently larger in diameter than the shaft so that the shaft can tilt and extend between the slots 60 and 62 when the movable arm is in the second position.

Figure 5:
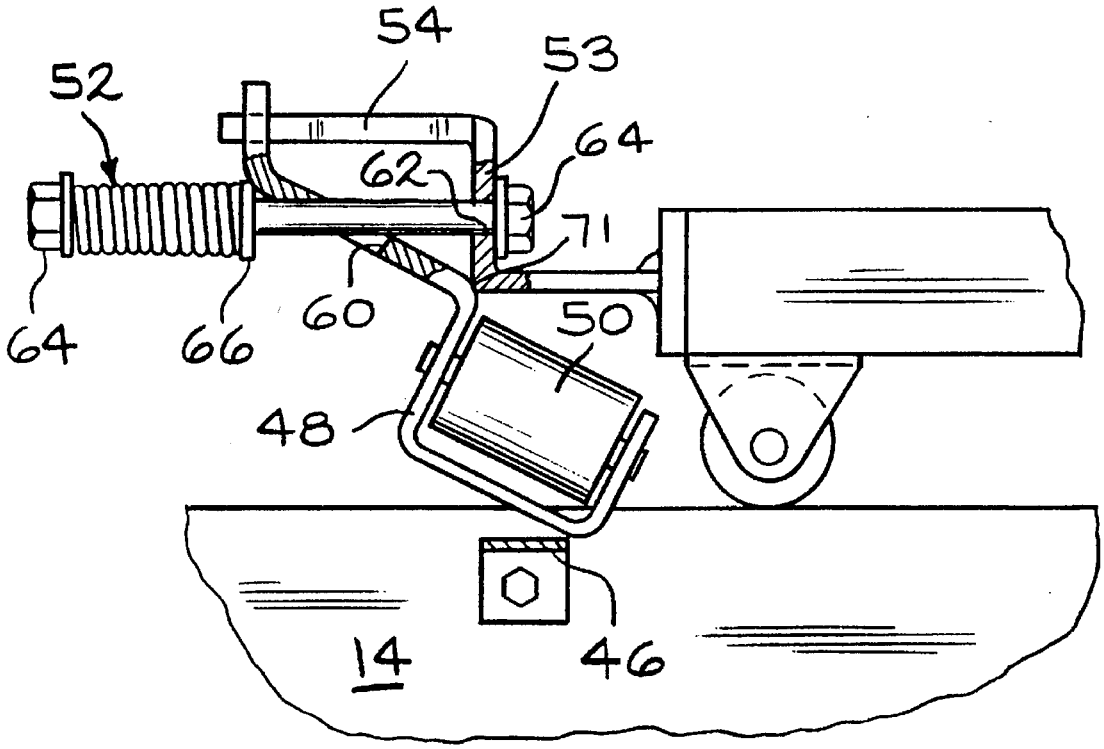
FIG. 5 is a side elevational view of a self-adjusting guide member shown in the second position.

FIG. 5 illustrates another embodiment of the guide member in which the guide member is self-actuating. As the carriage is moved in the first direction and an obstruction, such as strap 46, is encountered, the strap pushes on the guide member and moves it towards the second position. The movable arm pivots about pivot point 71. When the obstruction is passed the guide member returns to its normal first position by the force exerted from spring 56.

Figure 6:
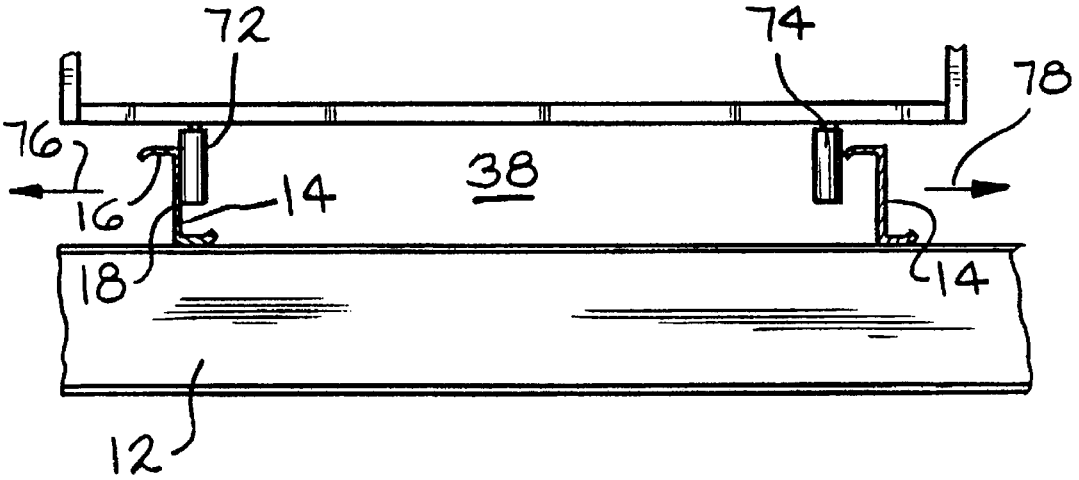
FIG. 6 is a schematic representation of an embodiment of the invention having two guide members.

FIG. 6 is a schematic representation of a carriage having first and second guide member rollers, 72 and 74 respectively. The first roller 72 prevents movement of the carriage in a first lateral direction 76, and the second roller prevents movement of the carriage in a second lateral direction 78. By having the first and second rollers attached to the carriage, movement is prevented from occurring in either lateral direction. Although it is shown that the two rollers are positioned so that both are located between the adjacent purlins, the rollers would work equally well if positioned on the outside of the adjacent purlins.

Figure 7:
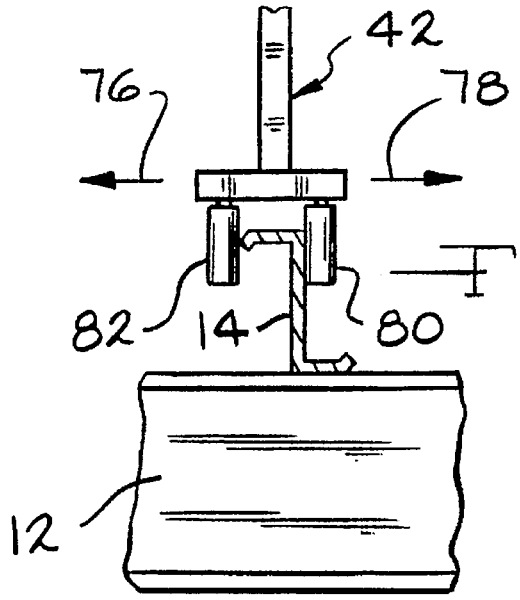
FIG. 7 is a schematic representation of another embodiment of the invention having a single guide member with two rollers.

FIG. 7 illustrates the carriage being guided by a single guide member having two rollers positioned on opposite sides of a single purlin. A first roller 80 is positioned on the side of the purlin so that it prevents movement in the first lateral direction 76. A second roller 82 is positioned on the side of the purlin so that it prevents movement in the second lateral direction 78. The use of either two rollers on a single guide member or two independent guide members prevents the carriage from moving in either lateral direction.

Figure 8:
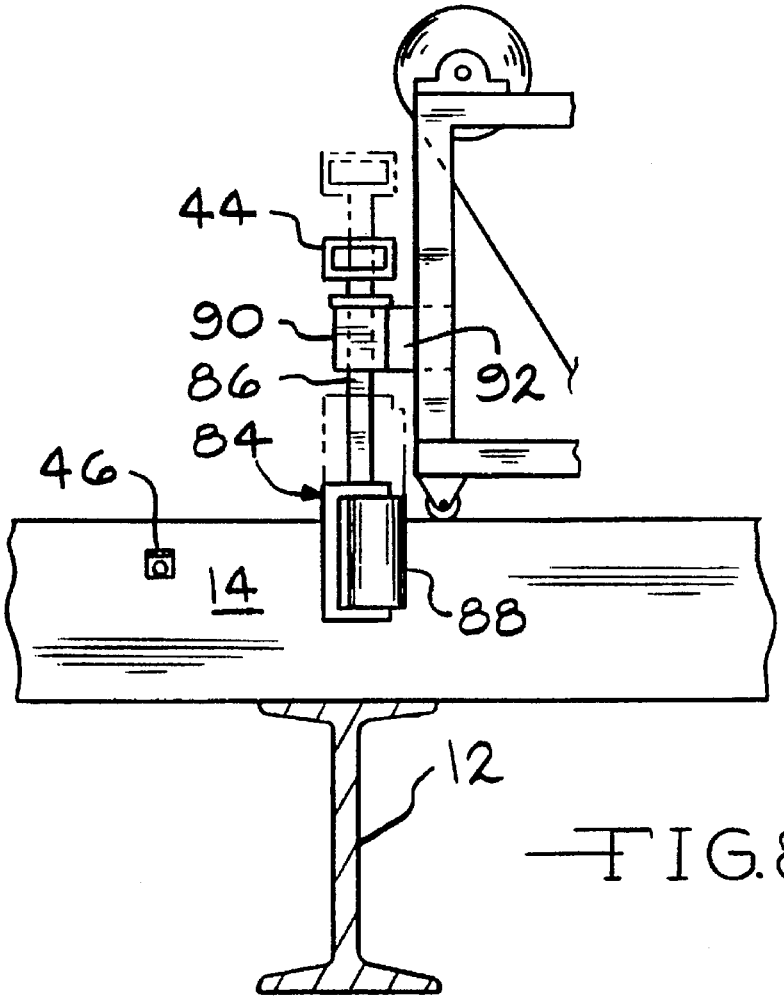
FIG. 8 is a schematic representation of another embodiment of the invention having a slidably mounted guide member.

The guide member can also be slideably mounted on the carriage rather than pivotally mounted. The guide member can be slideably mounted in any suitable configuration so that the guide member is elevated to the second position to avoid obstructions, such as strap 46. FIG. 8 illustrates a guide member 84 that includes a slideable arm 86 upon which roller 88 is attached. A sleeve 90 surrounds the arm and is attached to a mounting bracket 92. The mounting bracket is attached to the carriage. A handle 94 can be provided for lifting the guide member into the second position, indicated by the broken lines.

It will be evident from the foregoing that various modifications can be made to this invention. Such, however, are considered as being within the scope of the invention.

Industrial Applicability

The invention can be useful in the construction of roof structures for metal buildings.

We claim:

1. An apparatus for providing a roof structure of the type having a plurality of purlins spaced apart from one another in a parallel arrangement, comprising:

a carriage movable in a first direction along the length of the purlins for paying out a support sheet for support of insulation material as the carriage travels along the length of the purlins so that the support sheet depends from adjacent purlins;

at least one guide member guiding the carriage along the length of the purlins and preventing the carriage from moving in a direction lateral to the first direction when the guide member is in a first position, the guide member mounted on the carriage so that the guide member can be elevated into a second position away from obstructions encountered as the carriage moves along the length of the purlins; and a spring biasing the guide member towards the first position.

2. The apparatus of claim 1 in which the guide member is comprised of a guide surface which contacts the purlin for preventing the carriage from moving in the lateral direction.

3. The apparatus of claim 2 in which the guide surface comprises a roller mounted for rolling against a purlin while the guide member is in the first position.

4. The apparatus of claim 1 in which the guide member includes a handle for manually elevating the guide member to the second position.

5. The apparatus of claim 1 in which there is a first guide member preventing the carriage from moving in a first lateral direction, and a second guide member preventing the carriage from moving in a second lateral direction.

6. The apparatus of claim 5 in which the first and second guide members are comprised of rollers mounted for rolling against purlins while each guide member is in the first position.

7. The apparatus of claim 1 in which a single guide member comprises first and second rollers mounted to be positioned on opposite sides of a purlin, the first roller preventing the carriage from moving in a first lateral direction, and the second roller preventing the carriage from moving in a second lateral direction.

8. The apparatus of claim 1 in which the guide member is slideably mounted on the carriage and can be slideably elevated to the second position to avoid obstructions.

9. The apparatus of claim 8 which the guide member is comprised of a handle for manually elevating the guide member to the second position.

10. An apparatus for providing a roof structure of the type having a plurality of purlins spaced apart from one another in a parallel arrangement, comprising:

a carriage movable in a first direction along the length of the purlins for paying out a support sheet for support of insulation material as the carriage travels along the length of the purlins so that the support sheet depends from adjacent purlins; and at least one guide member guiding the carriage along the length of the purlins and preventing the carriage from moving in a direction lateral to the first direction when the guide member is in a first position, the guide member including a movable arm and a guide surface which contacts the purlin to prevent the carriage from moving in a lateral direction, where the movable arm is pivotably mounted on the carriage so that the guide member can be elevated into a second position away from obstructions encountered as the carriage moves in the first direction.

11. The apparatus of claim 10 in which the guide member pivots in a vertical plane parallel to the purlins.

12. The apparatus of claim 10 in which the guide surface is a roller mounted on the movable arm.

13. The apparatus of claim 10 in which the guide member further comprises a spring having two ends, one of the ends engaging the movable arm and the other end engaging the carriage, the spring biasing the movable arm towards the first position.

14. Apparatus for providing a roof structure of the type having a plurality of purlins spaced apart from one another in a parallel arrangement, comprising:

a. a carriage movable in a first direction along the length of the purlins for paying out a support sheet for support of insulation material as the carriage travels along the length of the purlins so that the support sheet depends from the top portion of adjacent purlins; and b. at least one guide member guiding the carriage along the length of the purlins and preventing the carriage from moving in a direction lateral to the first direction when the guide member is in a first position, the guide member comprising a movable arm and a roller, where the arm is pivotally mounted on the carriage for movement of the roller in a vertical plane parallel to the purlins so that the roller can be elevated into a second position away from obstructions encountered as the carriage moves along the length of the purlins.

15. The apparatus of claim 14 further comprising a spring biasing the guide member towards the first position.

16. Apparatus for providing a roof structure of the type having a plurality of purlins spaced apart from one another in a parallel arrangement, comprising:

a. a carriage movable in a first direction along the length of the purlins for paying out a support sheet for support of insulation material as the carriage travels along the length of the purlins so that the support sheet depends from the top portion of adjacent purlins; and b. at least one guide member guiding the carriage along the length of the purlins and preventing the carriage from moving in a direction lateral to the first direction when the guide member is in a first position, the guide member pivotally mounted on the carriage so that the guide member can be elevated into a second position to avoid obstructions encountered as the carriage moves along the length of the purlins, the guide member comprising:

1) a movable arm pivotally mounted on the carriage;

2) a roller mounted on the movable arm for rolling against a purlin while the guide member is in the first position;

3) a spring having two ends, one of the ends engaged with the movable arm and the other end engaged with the carriage, the spring biasing the movable arm towards the first position; and 4) a handle attached to the movable arm for manually elevating the guide member to the second position.

17. The apparatus of claim 16 in which the guide member is mounted on the carriage so that when an obstruction is encountered as the carriage is moving in the first direction the obstruction pushes on the guide member to the second position, and when the obstruction is passed, the guide member returns to the first position.

* * * * *